US007742713B2

(12) United States Patent
Mizes et al.

(10) Patent No.: US 7,742,713 B2
(45) Date of Patent: Jun. 22, 2010

(54) MEASUREMENT OF ENGINE RESPONSE CURVE IN THE PRESENCE OF PROCESS DIRECTION NOISE

(75) Inventors: Howard Mizes, Pittsford, NY (US); Claude S. Fillion, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 468 days.

(21) Appl. No.: 11/973,561

(22) Filed: Oct. 9, 2007

(65) Prior Publication Data

US 2009/0092408 A1 Apr. 9, 2009

(51) Int. Cl.
*G03G 15/00* (2006.01)

(52) U.S. Cl. ..... 399/49

(58) Field of Classification Search ..... 399/49, 399/60, 72; 347/19

See application file for complete search history.

(56) References Cited

U.S. PATENT DOCUMENTS 4,553,033 A 11/1985 Hubble, III et al.
6,760,056 B2 7/2004 Klassen et al.
6,819,352 B2 11/2004 Mizes et al.
7,090,324 B2 8/2006 Mizes
7,095,531 B2 8/2006 Mizes et al.
7,120,369 B2 10/2006 Hamby et al.
7,125,094 B2 10/2006 Mizes
7,162,172 B2 * 1/2007 Grace et al. ..... 399/49
7,236,711 B2 * 6/2007 Burry et al. ..... 399/49
7,272,333 B2 * 9/2007 Mizes ..... 399/49
7,382,993 B2 * 6/2008 Mongeon et al. ..... 399/49
7,495,799 B2 * 2/2009 Mongeon ..... 358/1.9
7,505,173 B2 * 3/2009 Viturro et al. ..... 358/1.9
7,593,130 B2 * 9/2009 Mongeon et al. ..... 358/1.4

* cited by examiner

*Primary Examiner*—Robert Beatty
(74) *Attorney, Agent, or Firm*—Fay Sharpe LLP

(57) ABSTRACT

Disclosed is a method and system for compensating for printer cross-process nonuniformity. The method and system provide a means to offset a cross-process uniformity profile associated with an image output device, such as a printer, where process direction noise is measured and the cross-process uniformity profile is adjusted accordingly to provide a better representation of the image output device cross-process uniformity profile.

20 Claims, 6 Drawing Sheets

MEASUREMENT OF ENGINE RESPONSE CURVE IN THE PRESENCE OF PROCESS DIRECTION NOISE

BACKGROUND

Defects in the subsystems of a xerographic, electrophotographic or similar image forming system, such as a laser printer, digital copier or the like, may give rise to visible streaks in a printed image. Streaks are primarily one-dimensional defects in an image that run parallel to the process direction. Typical defects might arise from a non-uniform LED imager, contamination of the high voltage elements in a charger, scratches in the photoreceptor surface, etc. In a uniform patch of gray, streaks and bands may appear as a variation in the gray level. In general, "gray" refers to the intensity value of any single color separation layer, whether the toner is black, cyan, magenta, yellow or some other color.

One method of reducing such streaks is to design and manufacture the critical parameters of the marking engine subsystems to tight specifications. Often though, such precision manufacturing will prove to be cost prohibitive.

One technique to eliminate these streaks is to measure the cross process uniformity of a series of strips of different gray levels. Each strip is first averaged in the process direction to produce a profile for that gray level. A printer model is then constructed from the profiles, which is used to calculate a set of spatial tone reproduction curves (s-TRC's). The s-TRCs are a set of TRCs that capture variation in the cross-process direction and are used to compensate the streaking. If the printer has process direction banding, if the strip density depends on the photoreceptor position, or if the illumination of the sensor changes with time, then the mean strip profile will vary between strips. These errors are called process direction noise. This noise will lead to an imperfect measurement of the engine response curve (ERC), thus an error in the printer model and an imperfect compensation.

A tone reproduction curve (TRC) may be measured by printing patches of different bitmap area coverage. In some digital image processing applications, the reflectivity of a patch of gray is measured with a toner area coverage sensor. The manner of operation of the toner area coverage sensor is described in U.S. Pat. No. 4,553,033, which is incorporated herein by reference in its entirety. Toner area coverage sensors are typically designed with an illumination beam much larger than the halftone screen dimension. In addition, the toner area coverage sensors are typically designed to measure a fixed position and do not have the capability to move in the cross process direction. This large beam does not provide the resolution for the toner area coverage sensor to be useful as a sensor for the narrow streaks that may occur for poorly performing subsystems.

U.S. Pat. No. 6,760,056 by Klassen et al., incorporated herein by reference in its entirety, discloses one exemplary embodiment of a method for compensating for streaks by introducing a separate tone reproduction curve for each pixel column in the cross process direction. A compensation pattern is printed and then scanned to first measure the engine response curve at each spatial position and then detect and measure streaks. The tone reproduction curves for the pixel columns associated with the streak are then modified to compensate for the streak.

INCORPORATION BY REFERENCE

U.S. Pat. No. 7,095,531, entitled "SYSTEMS AND METHODS FOR COMPENSATING FOR STREAKS IN IMAGES," by Mizes et al., issued Aug. 22, 2006.

U.S. Pat. No. 6,760,056, entitled "MACRO UNIFORMITY CORRECTION FOR X-Y SEPARABLE NON-UNIFORMITY," by Klassen et al., issued Jul. 6, 2004.

U.S. Pat. No. 4,553,033, entitled "INFRARED REFLECTANCE DENSITOMETER," by Hubble, III et al., issued Nov. 12, 1985.

U.S. Pat. No. 7,125,094, entitled "SYSTEMS AND METHODS FOR COMPENSATING FOR STREAKS IN IMAGES," by Mizes, issued Oct. 24, 2006.

U.S. Pat. No. 7,120,369, entitled "METHOD AND APPARATUS FOR CORRECTING NON-UNIFORM BANDING AND RESIDUAL TONER DENSITY USING FEEDBACK CONTROL," by Hamby et al., issued Oct. 10, 2006.

U.S. Pat. No. 7,090,324, entitled "SYSTEM AND METHODS FOR COMPENSATING FOR STREAKS IN IMAGES," by Mizes, issued Aug. 15, 2006.

U.S. Pat. No. 6,819,352, entitled "METHOD OF ADJUSTING PRINT UNIFORMITY," by Mizes et al., issued Nov. 16, 2004.

BRIEF DESCRIPTION

According to one aspect of this disclosure, a method of compensating for printer cross-process nonuniformities is described. The method of compensating comprises (a) printing a plurality of printer cross-process aligned test patterns on a substrate associated with the printer, the plurality of test patterns comprising a plurality of print densities associated with a plurality of respective target print densities, wherein the plurality of test patterns are configured to subsequently quantify printer process direction noise associated with the printer; (b) determining the actual print density associated with the plurality of test patterns relative to a plurality of printer cross-process locations to generate an initial printer cross-process uniformity profile; (c) determining the effects of printer process direction noise on the determined actual print densities associated with the plurality of test patterns; (d) generating a second printer cross-process uniformity profile which offsets the effects of the determined printer process direction noise; and (e) generating a TRC which compensates for the second printer cross-process uniformity profile.

According to another aspect of this disclosure, a computer program product is described. The computer program product comprises a computer-usable data carrier storing instructions that, when executed by a computer, causes the computer to perform a method of compensating for printer cross-process nonuniformities comprising (a) printing a plurality of printer cross-process aligned test patterns on a substrate associated with the printer, the plurality of test patterns comprising a plurality of print densities associated with a plurality of respective target print densities, wherein the plurality of test patterns are configured to subsequently quantify printer process direction noise associated with the printer; (b) determining the actual print density associated with the plurality of test patterns relative to a plurality of printer cross-process locations to generate an initial printer cross-process uniformity profile; (c) determining the effects of printer process direction noise on the determined actual print densities associated with the plurality of test patterns; (d) generating a second printer cross-process uniformity profile which offsets the effects of the determined printer process direction noise; and (e) generating a second TRC which compensates for the second printer cross-process uniformity profile.

According to another aspect of this disclosure, a xerographic printing process is described. The xerographic printing process comprises (a) printing a plurality of printer cross-process aligned test patterns on a substrate associated with the printer, the plurality of test patterns comprising a plurality of print densities associated with a plurality of respective target print densities, wherein the plurality of test patterns are configured to subsequently quantify printer process direction noise associated with the printer; (b) determining the actual print density associated with the plurality of test patterns relative to a plurality of printer cross-process locations to generate an initial printer cross-process uniformity profile; (c) determining the effects of printer process direction noise on the determined actual print densities associated with the plurality of test patterns; (d) generating a second printer cross-process uniformity profile which offsets the effects of the determined printer process direction noise; and (e) generating a second TRC which compensates for the second printer cross-process uniformity profile.

DETAILED DESCRIPTION

Figure 1:
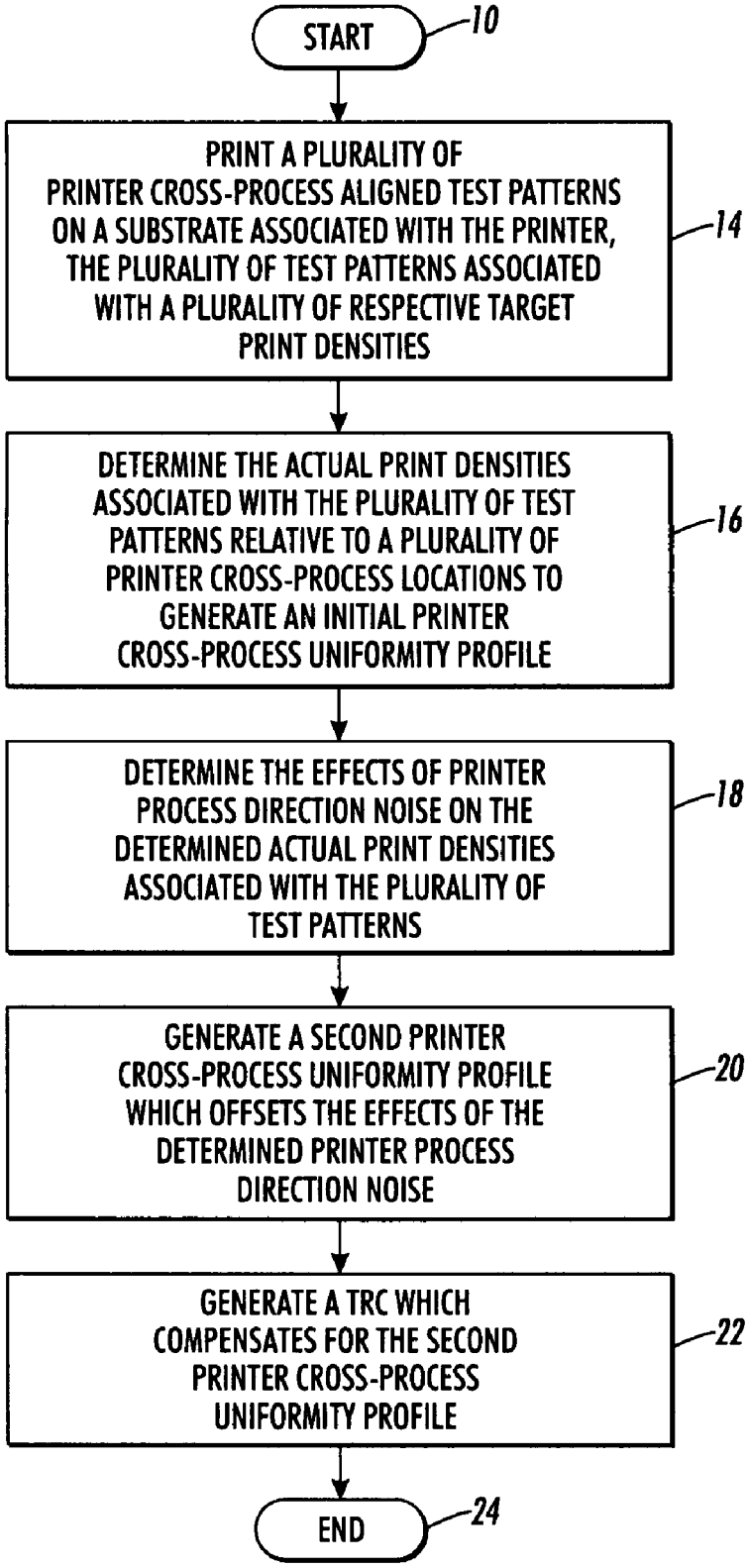
FIG. 1 is a flow chart illustrating a method of compensating for cross-process nonuniformities according to an exemplary embodiment of this disclosure.

Disclosed are a variety of techniques to eliminate the variations described in the background section of this disclosure. The common theme of the techniques is that reference patches are applied in various ways to quantify the process direction noise. To summarize, according to one disclosed technique, a calibration gray patch is printed adjacent to every strip. In the presence of process direction noise, the process direction noise is quantified by the response of the calibration patch. The calibration patch response is used to adjust the average gray level of the strip which is being used to monitor the uniformity. According to another disclosed technique, the same gray level strip is printed at different areas along the belt. The difference between the mean of each strip and the global mean over all strips is used to adjust the response of all other patches in its vicinity. In still another disclosed technique, a strip, not just of one gray level but of multiple gray levels is printed. Each strip has these multiple gray levels, but in different positions along the strip. Therefore, when the uniformity profile for a particular gray level is built up, it comes from many positions on the belt and any process direction noise is averaged over and the mean of each multiple gray level strip is calculated. The difference between each strip mean and the global mean over all strips is used to adjust the gray level.

As briefly discussed in the background section of this disclosure, printer subsystems may give a performance that is not uniform across the process direction. For example, exposure subsystems may give a spot size that varies across the process direction; the level to which a photoreceptor changes may vary across the process; and the development efficiency may change from one side to the other. All these variations can lead to objectionable streaks in an image.

The following detailed discussion and referenced drawings describe techniques to compensate for objectionable streaks. Moreover, the techniques disclosed provide a means for quantifying printer process direction noise. The quantified process direction noise provides a means for accurately measuring the cross-process uniformity associated with a printer for a range of toner densities without the effects of the quantified process direction noise. This method and system of determining the cross-process uniformity associated with a printer provides a means for generating s-TRC's (Spatial Tone Reproduction Curves) to compensate for objectionable streaks determined by the cross-process uniformity profile process.

Notably, this disclosure and the following detailed description are directed to electrostatic printers which use toner to render an image on a substrate. However, it is to be understood the methods and systems disclosed are not limited to electrostatic printers. For example, the disclosed process direction noise quantifying techniques may also be used to improve the image rendering associated with direct image marking systems such as ink jet printers. Other applications potentially include optical scanners for removal of objectionable noise and image displays. In addition, the detailed description and preferred embodiments disclosed are directed to a method/system which utilizes test patterns of various gray levels or toner densities to quantify the process direction noise and generate s-TRC'however, it is to be understood these methods/systems are applicable to other color test patterns, including one or more colors such as cyan, magenta, and yellow.

According to one aspect of this disclosure, streaks can be compensated by changing the input gray level to a printer as a function of the cross-process position. In order to determine the amount to change the gray level at each position to compensate for a streak, it is necessary to determine a printer model. A printer model is an estimate of the engine response curve (ERC). The ERC is estimated by printing a series of strips at different gray levels and measuring the density as a function of gray level. This curve is inverted to determine the change in the gray level needed to obtain the desired print density in the presence of nonuniformities.

Notably, printer variations in the process direction can lead to an inaccurate measurement of the ERC. The print density can vary as a function of the position along a printer photoreceptor belt or drum along the process direction. There can also be random noise which limits the ability to measure the average response of an image sensor to a particular gray level.

Figure 6:
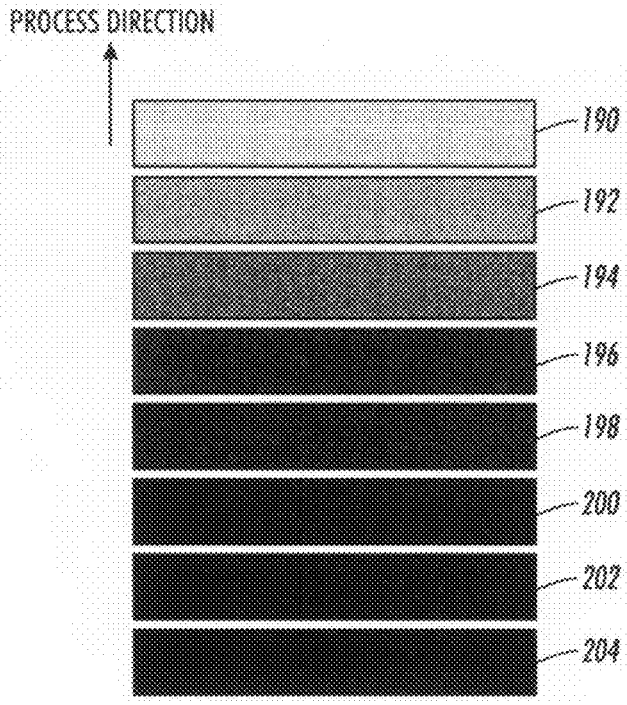
FIG. 6 illustrates a conventional test pattern used to generate a tone reduction curve (TRC)

With reference to FIG. 6, illustrated is one example of a possible test pattern that does not include the process direction noise quantifications method/system described in this disclosure. The test pattern includes a first gray scale strip 190, a second gray scale strip 192, a third gray scale strip 194, a fourth gray scale strip 196, a fifth gray scale strip 198, a sixth gray scale strip 200, a seventh gray scale strip 202 and an eighth gray scale strip 204. Each of the respective gray scale strips represents a different target gray scale, where the first gray sale strip 190 is representative of a relatively light gray scale tone and the eighth gray scale strip 204 is representative of a relatively dark gray scale tone.

To generate an ERC for a particular printer, the test pattern of FIG. 6 is printed on a substrate associated with a printer. For example, the test pattern is directly printed on a media sheet, or an intermediate transfer device such as a drum or photoreceptor belt.

Figure 7:
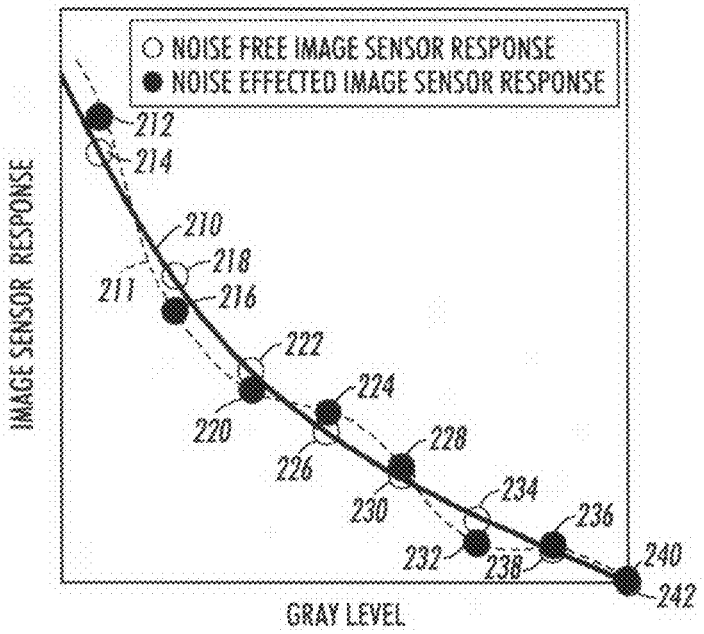
FIG. 7 illustrates a true engine response curve (ERC) without the effects of process direction noise and a measured engine response curve with the presence of process direction noise.

With reference to FIG. 7, illustrated is the response of an image sensor used to measure the gray level strips illustrated in FIG. 6, for example, an in-line or off-line linear array sensor which is longitudinally aligned in the cross-process direction, relative to the printed test pattern of FIG. 6. The open circles 214, 218, 222, 226, 230, 234, 238 and 242 represent the noise free image sensor response to test pattern strips 190, 192, 194, 196, 198, 200, 202 and 204, respectively. The solid circles 212, 216, 220, 224, 228, 232, 236 and 240 represent the measured noise effected image sensor response to test pattern strips 190, 192, 194, 196, 198, 200, 202 and 204, respectively. Because the slope of the response curve 211 for the measured noise effected response is different from the slope of the noise free target response 210, the gray level required to compensate at a particular gray level will be inaccurate.

With reference to FIG. 1, illustrated is a method of compensating for cross-process nonuniformities according to an exemplary embodiment of this disclosure. This method provides a basis for measuring the process direction noise associated with a printer and subsequently generating a printer cross-process uniformity profile which offsets the effects of the measured printer process direction noise.

The exemplary method illustrated in FIG. 1 operates as follows:

(1) initialize the printer cross-process uniformity profile process 10;

(2) printing a plurality of printer cross-process aligned test patterns on a substrate associated with the printer, the plurality of test patterns associated with a plurality of respective target print densities 14;

(3) determining the actual print densities associated with the plurality of test patterns relative to a plurality of printer cross-process locations to generate an initial printer cross-process uniformity profile 16;

(4) determining the effects of printer process direction noise on the determined actual print densities associated with the plurality of test patterns 18;

(5) generating a second printer cross-process uniformity profile which offsets the effects of the determined printer process direction noise 20;

(6) generating a TRC which compensates for the second printer cross-process uniformity profile 22; and (7) ending the printer cross-process uniformity profile process 24.

Figure 2:
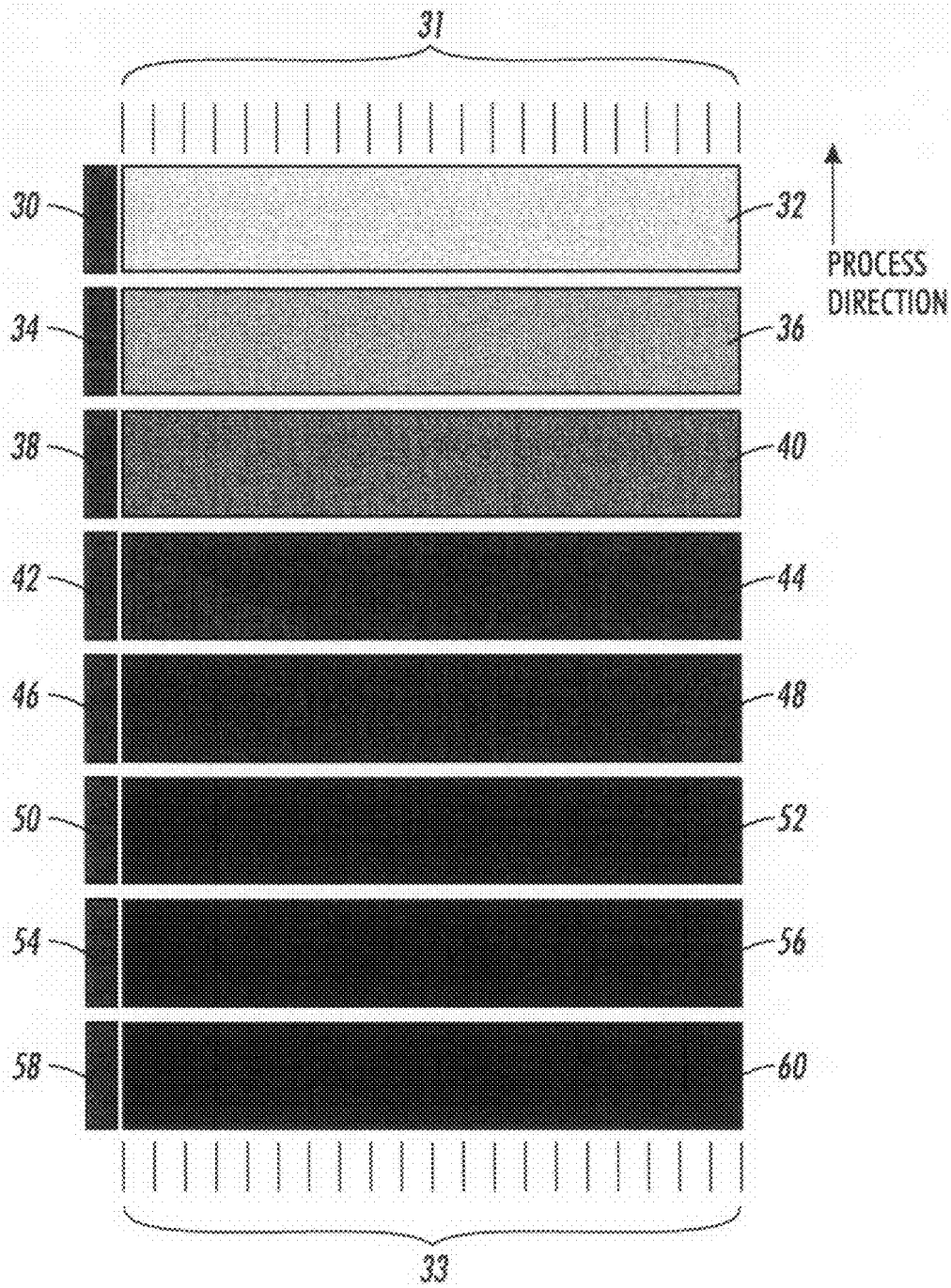
FIG. 2 illustrates a test pattern used to quantify printer process direction noise according to an exemplary embodiment of this disclosure.

With reference to FIG. 2, illustrated is one test pattern that can be used to calculate the error in the measurement. The calibration patches to the left (i.e. 30, 34, 38, 42, 46, 50, 54 and 58) of the strips (i.e. 32, 36, 40, 44, 48, 52, 56 and 60) are all printed at the same gray level. If the density of a calibration patch is larger than the mean calibration patch response, then the response of the uniformity strip is decreased. If the density of the calibration patch is smaller than the mean calibration patch response, then the response of the uniformity strip is increased.

In other words, the print density of the calibration patches 30, 34, 38, 42, 46, 50, 54 and 58 is measured with a linear array sensor as the substrate travels in the process direction indicated. Furthermore, the print density of strips 32, 36, 40, 44, 48, 52, 56 and 60 are measured with the linear array sensor as the substrate travels in the process direction. Fiducial marks 31 and 33 provide a means for correlating strip density measurements along the cross-process direction. Notably, the linear array sensor is aligned along the cross-process direction to provide the necessary density measurements for generating a uniformity profile.

To compensate for process direction noise, the uniformity profile measurements obtained with the spectrophotometer are adjusted for a specific strip based on the print density associated with the strip's respective calibration patch.

For example, if the measured print density associated with calibration patch 30 is less than the mean print density associated with all the calibration patches (i.e. 30, 34, 38, 42, 46, 50, 54 and 58), the overall response of the linear array sensor measurements of strip 32 is decreased because process direction noise has effectively produced a relatively lower print density (i.e. a higher response of the linear array sensor due to relatively higher reflected light) than would be printed in the absence of process direction noise.

Stated another way, to better represent the cross-process uniformity profile associated with the printer, the process direction noise is quantified based on the measured print densities associated with the calibration patches and the measured cross-process uniformity profile associated with the strips is offset or compensated to reduce process direction noise associated with the measured cross-process uniformity profile.

The magnitude of the process direction signature is gray level dependent. For example, at a 50% area coverage the signature might give a variation along the photoreceptor of 5%, but at a 75% area coverage the variation along the photoreceptor might be only 2%. These scaling factors can be measured ahead of time and then used to scale the correction to the uniformity strip. Using these above numbers as an example, if we find that the calibration patch is 3% darker than the mean calibration patch, then a 75% uniformity strip should be decreased by 3% (2/5) from its measured intensity.

Figure 3:
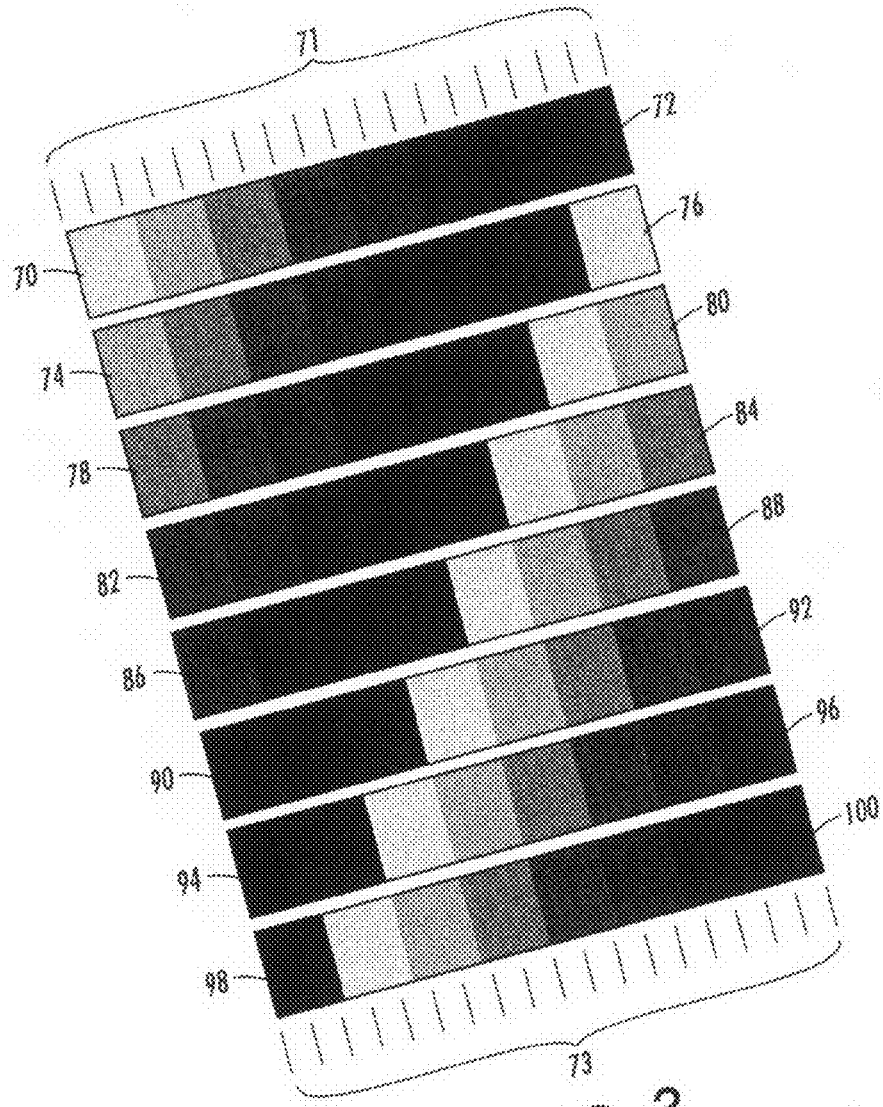
FIG. 3 illustrates a test pattern used to quantify printer process direction noise according to another exemplary embodiment of this disclosure.

An alternative way to minimize the photoreceptor signature effects and random noise effects is to use a test pattern as illustrated in FIG. 3. In FIG. 3, each gray level occurs at different positions on different strips. Any particular gray level will occur at a different cross process position in each patch. Any particular gray level taken over all strips will sample all points in the cross process direction. In the absence of process direction noise, the average of the profile for each strip will be equal because each strip contains patches of all the gray levels. In the presence of process direction noise, the average of the profile for each strip will not be equal. The difference between the average over any one strip and the global average quantifies the magnitude of the process direction noise. The section of the profile over each patch is corrected by a scale factor of this difference as described above. Once these corrections are made, the corrected profiles corresponding to patches of the same gray level of different strips are reconstructed to give the profile corresponding to that gray level with the process direction noise removed.

For example, with reference to FIG. 3, illustrated is a series of strips 70, 74, 78, 82, 86, 90, 94 and 98, wherein fiducial marks 71 and 73 are provided to spatially correlate print density measurements associated with a spectrophotometer. Each strip includes a plurality of patches representing a series of different print densities. Notably, each strip includes an identical set of patches of different print densities, i.e. 72, 76, 80, 84, 88, 92, 96 and 100.

Figure 4:
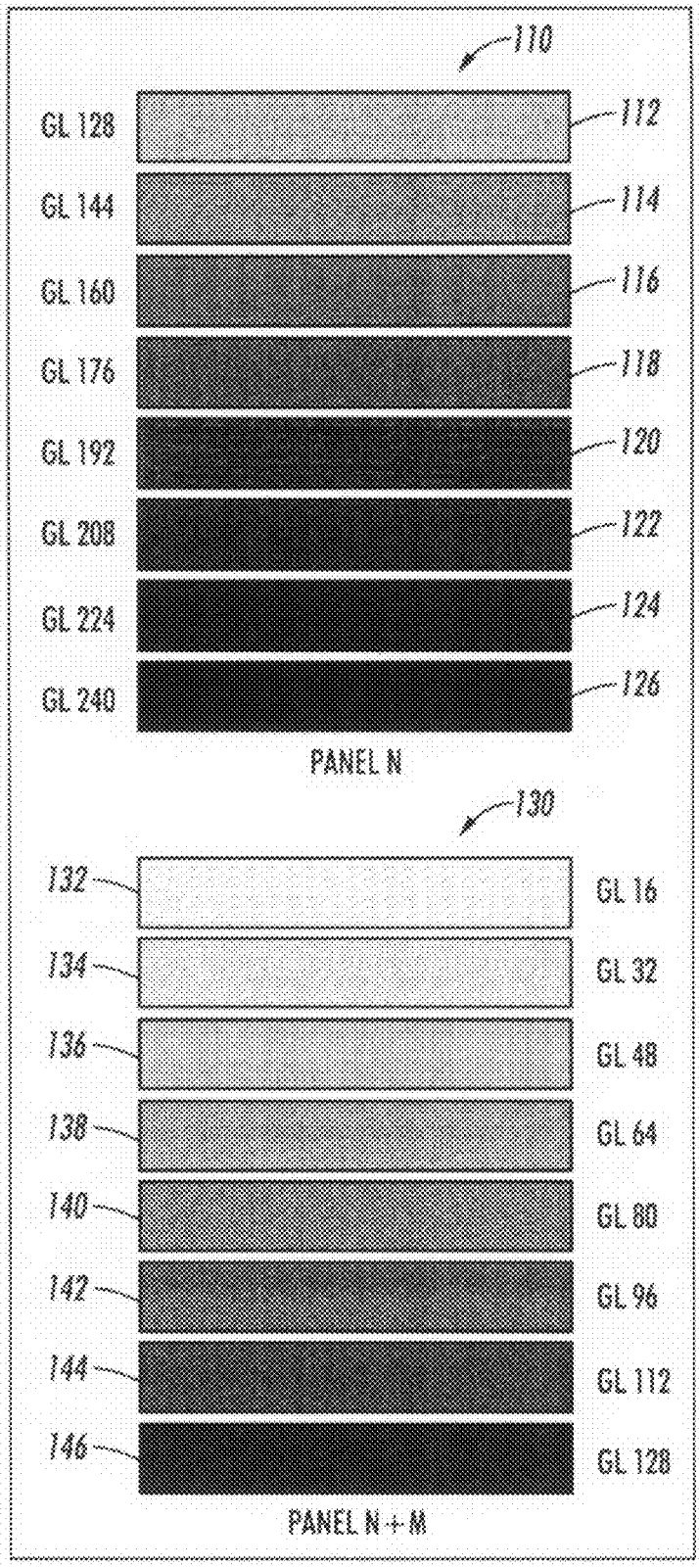
FIG. 4 illustrates a series of test patterns used to quantify printer process direction noise according to another exemplary embodiment of this disclosure, wherein the series of test patterns span a plurality of image panels.

With reference to FIG. 4, illustrated is another exemplary embodiment of this disclosure, wherein a particular gray level strip, such as 112 and 146 which represent gray level 128, is repeated on two different panels.

A panel is defined as a rectangle spanning the full width of the photoreceptor belt or drum and some finite amount of distance in the process direction. For example, according to one aspect of this disclosure, 8 patches per color are printed on a single panel and 14 gray levels are used to characterize the TRC. Therefore, the strips need to spread the gray levels across 2 pitches. For some printing systems, the print density for the same gray level will vary insignificantly within a panel but significantly between panels. Therefore, there can be a kink in the TRC due to the variation in the mean from pitch to pitch.

With continuing reference to FIG. 4, one manner of compensating for a kink in the TRC is now described.

Print one strip, 112 and 146, that is common to both panels 110 and 130. Determine the difference in the mean value between the two strips 112 and 146. Offset all the profiles in one of the panels by this difference scaled as discussed previously. Offsetting the profiles will make the mean values consistent and will minimize the kink in the TRC.

FIG. 4 illustrates a test pattern which will compensate for kinks as previously described. The test pattern includes a first panel N 110 and a second panel N+M 130. Panel 110 includes strips 110, 114, 116, 118, 120, 122, 124 and 126. Panel 130 includes strips 132, 134, 136, 138, 140, 142, 144, and 146.

Each panel includes a series of strips of different print densities as indicated by the respective gray levels (i.e. GL). For example, strip 112 has a gray level of 128, indicated as GL 128, strip 114 has a gray level of 144, indicated as GL 144, etc. As previously discussed, one strip of a particular gray level is present in both panels 110 and 130. For example, panel 110 includes strip 112 at GL 128 and panel 130 includes strip 146 at GL 128.

Figure 5:
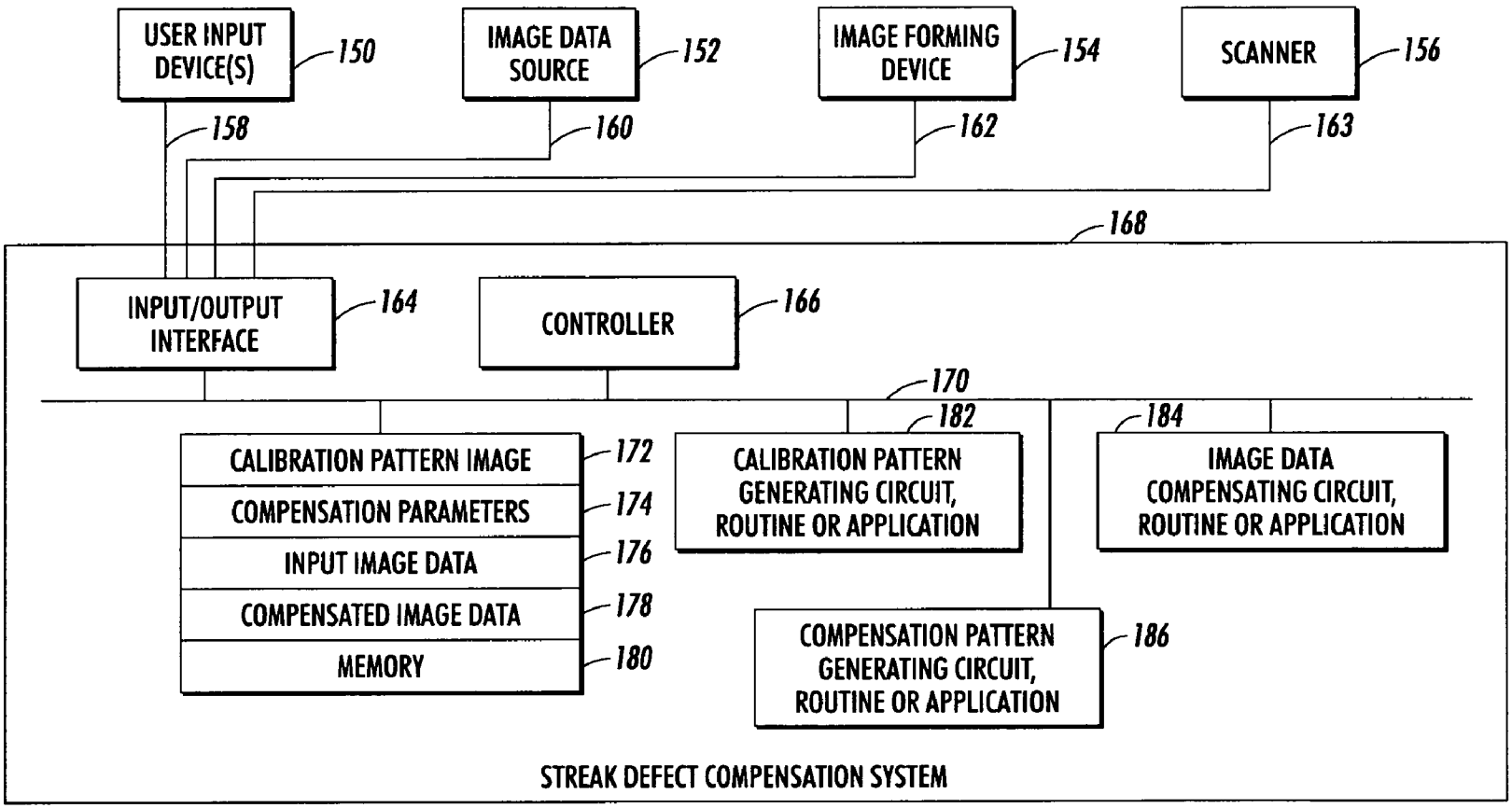
FIG. 5 is a block diagram of a printer streak compensation system according to an exemplary embodiment of this disclosure.

With reference to FIG. 5, illustrated is a block diagram of a printer streak compensation system according to an exemplary embodiment of this disclosure.

The system includes user input device(s) 150, an image data source 152, an image forming device 154, a scanner 156 and a streak defect compensation system 168. Data communication lines 158, 160, 162 and 163 provide the necessary communications between an input/output interface 164 associated with the streak defect compensation system 168 and the user input device(s) 150, image data source 152, image forming device 154 and scanner 156, respectively.

In addition to the input/output interface 164, the streak defect compensation system 168 includes a controller 166 which accesses and controls, via data communication lines 170, the input/output interface 164, calibration pattern image data 172, compensation parameter data 174, input image data 176 compensated image data 178, a memory 180, a calibration pattern generating circuit, routine or application 182, a compensation pattern generating circuit, routine or application 186 and an image data compensating circuit, routine or application 184.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of compensating for printer cross-process nonuniformities comprising:

(a) printing a plurality of printer cross-process aligned test patterns on a substrate associated with the printer, the plurality of test patterns comprising a plurality of print densities associated with a plurality of respective target print densities, wherein the plurality of test patterns are configured to subsequently quantify printer process direction noise associated with the printer;

(b) determining the actual print density associated with the plurality of test patterns relative to a plurality of printer cross-process locations to generate an initial printer cross-process uniformity profile;

(c) determining the effects of printer process direction noise on the determined actual print densities associated with the plurality of test patterns;

(d) generating a second printer cross-process uniformity profile which offsets the effects of the determined printer process direction noise; and (e) generating a TRC which compensates for the second printer cross-process uniformity profile.

2. The method of compensating for printer cross-process nonuniformities according to claim 1, step (a) comprising:

printing a plurality of test patterns on a substrate associated with the printer, each test pattern substantially longitudinally aligned parallel with the printer cross-process direction and each test pattern comprising a first and second portion, each first portion of each test pattern being associated with a common calibration target print density and the second portion of each test pattern being associated with a second target print density, wherein the second portion of each test pattern is associated with a different target print density; and step (b) comprising:

determining the actual print density associated with the respective first portions of the plurality of printed test patterns and calculating the average print density associated with the first portions of the plurality of printed test patterns; and determining the actual print density associated with each respective second portions of the plurality of printed test patterns.

3. The method of compensating for printer cross-process nonuniformities according to claim 2, further comprising:

scaling the second printer cross-process uniformity profile based on the variation of print density for a series of printed calibration patterns.

4. The method of compensating for printer cross-process nonuniformities according to claim 2, comprising:

generating a TRC for each target print density associated with each test pattern second portion, wherein the TRC is generated by adjusting the determined actual print density associated with the second portions of each test pattern relative to the difference between the average print density associated with the first portions of the plurality of printed test patterns and the actual print densities associated with the respective first portions of the plurality of printed test patterns.

5. The method of compensating for printer cross-process nonuniformities according to claim 1, wherein the plurality of printer cross-process aligned test patterns are gray level based.

6. The method of compensating for printer cross-process nonuniformities according to claim 1, wherein each of the plurality of test patterns comprises a common set of a plurality of print density patches and the equivalent print density patches are configured within each test pattern to offset equivalent print density patches relative to the printer cross-process direction.

7. A method of compensating for printer cross-process nonuniformities according to claim 1, wherein the plurality of cross-process aligned test patterns cover a plurality of substrate areas and each substrate area comprises a common test pattern of equivalent print densities, the method further comprising:

determining the difference in the mean values of the print density associated with the common test patterns of the respective substrate areas;

offsetting the second printer cross-process uniformity profiles associated with each substrate area by the determined print density difference from the mean value; and scaling the difference in the mean values of the print density by a factor that is dependent on the average print density.

8. The method of compensating for printer cross-process nonuniformities according to claim 7, wherein each substrate area comprises a plurality of common test patterns of equivalent print densities, the method further comprising:

determining the average differences in the mean values of the print densities associated with the pluralities of common test patterns of the respective substrate areas;

offsetting the second printer cross-process uniformity profiles associated with each substrate area by the determined print density average difference from the average mean value; and scaling the difference in the mean values of the print density by a factor that is dependent on the average print density.

9. A method of compensating for printer cross-process nonuniformities according to claim 2, wherein the plurality cross-process aligned test patterns cover a plurality of substrate areas, the method further comprising:

determining the difference in the mean values of the print density associated with the first portions of the plurality of printed test patterns associated with the respective substrate areas;

offsetting the second printer cross-process uniformity profiles associated with each substrate area by the determined print density difference from the mean value; and scaling the difference in the mean values of the print density by a factor that is dependent on the average print density.

10. A computer program product comprising:

a computer-usable data carrier storing instructions that, when executed by a computer, causes the computer to perform a method of compensating for printer cross-process nonuniformities comprising:

(a) printing a plurality of printer cross-process aligned test patterns on a substrate associated with the printer, the plurality of test patterns comprising a plurality of print densities associated with a plurality of respective target print densities, wherein the plurality of test patterns are configured to subsequently quantify printer process direction noise associated with the printer;

(b) determining the actual print density associated with the plurality of test patterns relative to a plurality of printer cross-process locations to generate an initial printer cross-process uniformity profile;

(c) determining the effects of printer process direction noise on the determined actual print densities associated with the plurality of test patterns;

(d) generating a second printer cross-process uniformity profile which offsets the effects of the determined printer process direction noise; and (e) generating a TRC which compensates for the second printer cross-process uniformity profile.

11. The computer program product according to claim 10, step (a) of the method of compensating for printer cross-process nonuniformities comprising:

printing a plurality of test patterns on a substrate associated with the printer, each test pattern substantially longitudinally aligned parallel with the printer cross-process direction and each test pattern comprising a first and second portion, each first portion of each test pattern being associated with a common calibration target print density and the second portion of each test pattern being associated with a second target print density, wherein the second portion of each test pattern is associated with a different target print density; and step (b) of the method of compensating for printer cross-process nonuniformities comprising:

determining the actual print density associated with the respective first portions of the plurality of printed test patterns and calculating the average print density associated with the first portions of the plurality of printed test patterns; and determining the actual print density associated with each respective second portions of the plurality of printed test patterns.

12. The computer program product according to claim 11, the method of compensating for printer cross-process nonuniformities further comprising:

scaling the second printer cross-process uniformity profile based on the variation of print density to a series of printed calibration patterns.

13. The computer program product according to claim 11, the method of compensating for printer cross-process nonuniformities comprising:

generating a TRC for each target print density associated with each test pattern second portion, wherein the TRC is generated by adjusting the determined actual print density associated with the second portions of each test pattern relative to the difference between the average print density associated with the first portions of the plurality of printed test patterns and the actual print densities associated with the respective first portions of the plurality of printed test patterns.

14. The computer program product according to claim 10, wherein, according to the method of compensating for printer cross-process nonuniformities, the plurality of printer cross-process aligned test patterns are gray level based.

15. The computer program product according to claim 10, wherein, according to the method of compensating for printer cross-process nonuniformities, the plurality of test patterns comprises a common set of a plurality of print density patches and the equivalent print density patches are configured within each test pattern to offset equivalent print density patches relative to the printer cross-process direction.

16. The computer program product according to claim 10, wherein, according to the method of compensating for printer cross-process nonuniformities, the plurality of cross-process aligned test patterns cover a plurality of substrate areas and each substrate area comprises a common test pattern of equivalent print densities, the method further comprising:

determining the difference in the mean values of the print density associated with the common test patterns of the respective substrate areas;

offsetting the second printer cross-process uniformity profiles associated with each substrate area by the determined print density difference from the mean value; and scaling the difference in the mean values of the print density by a factor that is dependent on the average print density.

17. The computer program product according to claim 16, wherein, according to the method of compensating for printer cross-process nonuniformities, each substrate area comprises a plurality of common test patterns of equivalent print densities, the method further comprising:

determining the average differences in the mean values of the print densities associated with the pluralities of common test patterns of the respective substrate areas;

offsetting the second printer cross-process uniformity profiles associated with each substrate area by the determined print density average difference from the average mean value; and scaling the difference in the mean values of the print density by a factor that is dependent on the average print density.

18. The computer program product according to claim 11, wherein, according to the method of compensating for printer cross-process nonuniformities, the plurality cross-process aligned test patterns cover a plurality of substrate areas, the method further comprising:

determining the difference in the mean values of the print density associated with the first portions of the plurality of printed test patterns associated with the respective substrate areas;

offsetting the second printer cross-process uniformity profiles associated with each substrate area by the determined print density difference from the mean value; and scaling the difference in the mean values of the print density by a factor that is dependent on the average print density.

19. A xerographic printing process comprising:

(a) printing a plurality of printer cross-process aligned test patterns on a substrate associated with the printer, the plurality of test patterns comprising a plurality of print densities associated with a plurality of respective target print densities, wherein the plurality of test patterns are configured to subsequently quantify printer process direction noise associated with the printer;

(b) determining the actual print density associated with the plurality of test patterns relative to a plurality of printer cross-process locations to generate an initial printer cross-process uniformity profile;

(c) determining the effects of printer process direction noise on the determined actual print densities associated with the plurality of test patterns;

(d) generating a second printer cross-process uniformity profile which offsets the effects of the determined printer process direction noise; and (e) generating a TRC which compensates for the second printer cross-process uniformity profile.

20. The xerographic printing process according to claim 19, step (a) comprising:

printing a plurality of test patterns on a substrate associated with the printer, each test pattern substantially longitudinally aligned parallel with the printer cross-process direction and each test pattern comprising a first and second portion, each first portion of each test pattern being associated with a common calibration target print density and the second portion of each test pattern being associated with a second target print density, wherein the second portion of each test pattern is associated with a different target print density; and step (b) comprising:

determining the actual print density associated with the respective first portions of the plurality of printed test patterns and calculating the average print density associated with the first portions of the plurality of printed test patterns; and determining the actual print density associated with each respective second portions of the plurality of printed test patterns.

* * * * *